US011639608B2

(12) United States Patent
Fillot et al.

(10) Patent No.: US 11,639,608 B2
(45) Date of Patent: May 2, 2023

(54) DEVICE FOR HEATING THE WATER OF AN ABOVE-GROUND POOL, SUCH AS AN ABOVE-GROUND SPA POOL OR A SWIMMING POOL

(71) Applicant: POLYTROPIC, Vourles (FR)

(72) Inventors: Jean-Christophe Fillot, Saint Genis Laval (FR); Maxime Desvignes, Feyzin (FR)

(73) Assignee: POLYTROPIC, Vourles (FR)

( * ) Notice: Subject to any disclaimer, the term of this patent is extended or adjusted under 35 U.S.C. 154(b) by 144 days.

(21) Appl. No.: 17/430,303

(22) PCT Filed: Jan. 31, 2020

(86) PCT No.: PCT/EP2020/052489
§ 371 (c)(1),
(2) Date: Aug. 11, 2021

(87) PCT Pub. No.: WO2020/164931
PCT Pub. Date: Aug. 20, 2020

(65) Prior Publication Data

US 2022/0195744 A1 Jun. 23, 2022

(30) Foreign Application Priority Data

Feb. 15, 2019 (FR) ..... 1901562

(51) Int. Cl.
*E04H 4/12* (2006.01)
*A61H 33/00* (2006.01)
*E04H 4/14* (2006.01)

(52) U.S. Cl.
CPC ..... *E04H 4/129* (2013.01); *A61H 33/0095* (2013.01); *E04H 4/144* (2013.01)

(58) Field of Classification Search
CPC ..... E04H 4/129; E04H 4/144; A61H 33/0095
(Continued)

(56) References Cited

U.S. PATENT DOCUMENTS 4,512,042 A * 4/1985 Striegel ..... E04H 4/144 4/496
2008/0148470 A1 6/2008 Ferriss et al.
(Continued)

FOREIGN PATENT DOCUMENTS

CN 2349299 Y 11/1999
CN 102362039 A 2/2012
(Continued)

OTHER PUBLICATIONS

INPI Rapport de Recherche Préliminaire for Patent Application No. FR 1901562, dated Nov. 28, 2019, 2 pp.
(Continued)

*Primary Examiner* — Tuan N Nguyen
(74) *Attorney, Agent, or Firm* — Soquel Group LLC

(57) ABSTRACT

A heating device is well-functioning, easy to install, aesthetically pleasing and convenient to use at the same time. It includes a frame having an upper face, which connects the rear and front faces and which generally has a step-shaped shape having at least two levels, which, in use, are at different respective heights and the highest level of which opens onto the rear face while the other levels are distributed substantially uniformly between a base of the frame and the highest level, such that, in use, a user may access the pool by successively walking on the levels of the step-shaped shape by climbing the levels from the ground to enter the pool and by descending the levels to the ground to leave the pool. The device also includes an air-water heat pump, arranged in an internal volume of the frame, which is defined between the base and the rear.

10 Claims, 2 Drawing Sheets

(58) Field of Classification Search
USPC ..... 4/493, 496, 504
See application file for complete search history.

(56) References Cited

U.S. PATENT DOCUMENTS

| | | | | |
|---|---|---|---|---|
| 2013/0334113 | A1* | 12/2013 | Erlich | E04H 4/144 210/167.1 |
| 2014/0318738 | A1* | 10/2014 | Bernardi | E04H 4/129 165/67 |
| 2018/0148945 | A1* | 5/2018 | Roux | E04H 4/0018 |

FOREIGN PATENT DOCUMENTS

| | | | |
|---|---|---|---|
| CN | 104000413 | A | 8/2014 |
| CN | 20478212 | U | 11/2015 |
| CN | 206220582 | U | 6/2017 |
| CN | 206800836 | U | 12/2017 |
| EP | 0599666 | A1 | 6/1994 |
| EP | 3216947 | A1 | 9/2017 |
| FR | 2950913 | A1 | 4/2011 |
| FR | 2987387 | A1 | 8/2013 |

OTHER PUBLICATIONS

International Search Report for Patent Application No. PCT/EP2020/052489, dated Mar. 18, 2020, 2 pp.

* cited by examiner

DEVICE FOR HEATING THE WATER OF AN ABOVE-GROUND POOL, SUCH AS AN ABOVE-GROUND SPA POOL OR A SWIMMING POOL

CROSS-REFERENCE TO RELATED APPLICATIONS

This application claims benefit under 35 USC § 371 of PCT Application No. PCT/EP2020/052489 entitled DEVICE FOR HEATING THE WATER OF AN ABOVE-GROUND POOL, SUCH AS AN ABOVE-GROUND SPA POOL OR A SWIMMING POOL, filed on Jan. 31, 2020 by inventors Jean-Christophe Fillot and Maxime Desvignes. PCT Application No. PCT/EP2020/052489 claims priority of French Patent Application No. 19 01562, filed on Feb. 15, 2019.

FIELD OF THE INVENTION

The present invention relates to a device for heating the water of an above-ground swimming pool. It also relates to a bathing facility comprising such a heating device.

BACKGROUND OF THE INVENTION

The invention relates to above-ground swimming pools, which covers, inter alia, whirlpools, non-underground spas, self-supporting above-ground pools and above-ground pools with supports. Regardless of their design, these above-ground swimming pools have an enclosure, intended to contain water and large enough for one or more adults to bathe in it by immersing their body in the water, at least partially. This enclosure is above ground, that is, it rises from the ground, without being buried or being buried marginally at its base, which further requires the user(s) to step over the edge of the side wall of the enclosure to enter or exit the pool, this done either by stepping over the side wall of the enclosure or by using a staircase, small ladder, footstool, stepladder or similar equipment, juxtaposed to the outside face of the side wall of the enclosure.

Moreover, these above-ground swimming pools are equipped with a hydraulic circuit that allows the water contained in the enclosure to be circulated outside of the latter in order to treat it before returning it to the enclosure, the treatment or treatments implemented capable of being of various kinds, depending on the pool form design: for example, in the case of a spa or a whirlpool, these treatments may be water filtration and then a mix of water and pressurized air to deliver a water bubble jet into the enclosure; in the case of a swimming pool, these treatments may be filtration and then chemical treatment of the water. In all cases, the water circulation in the hydraulic circuit is driven by a pump of this circuit, generally electric.

In order to heat the water in the above-ground pool, it is known to use an air-water heat pump, which is connected to the hydraulic circuit of the pool and which allows the heat to be transferred from the air to the water circulating in the hydraulic circuit. Such a heat pump is efficient, functioning better than heating resistance electrical systems. However, it is bulky and difficult to integrate in the immediate vicinity of above-ground pools without affecting their aesthetics, which is not an option for luxury or well-being facilities, such as spas or whirlpools. Of course, the heat pump can be moved away from the above-ground pool, for example, to conceal it from the pool, but this is detrimental to the efficiency and operating costs of the heat pump.

In a field away from of above-ground swimming pools, namely the field of in-ground pools, EP 0 599 666 discloses a technical unit for an in-ground pool. This technical unit is intended to be arranged adjacent to an in-ground swimming pool, resting on the base of this swimming pool and including a waterproof partition that forms part of the side wall of the swimming pool. This watertight partition is provided with one or more portholes or glass windows, which allow a person, standing inside a cavity of the technical unit, to observe the interior of the pool, as if underwater. Inside the cavity of the technical unit, one or more stairs are arranged, the steps of which are immersed in the water of the pool and which allow a user to enter the interior of the pool by progressively descending as the user advances from the side of the technical unit, opposite to the watertight partition, to this watertight partition. Therefore, even under the artificial assumption that this technical unit would be associated with an above-ground pool, this technical unit would not allow a user standing on the ground outside the pool to easily access the interior of the pool, since the aforementioned staircase(s) are turned the "wrong way".

SUMMARY OF THE INVENTION

The purpose of the present invention is to provide a heating device for an above-ground swimming pool, which is both aesthetically pleasing and convenient to us while being efficient and easy to install.

To this end, the object of the invention is a device for heating the water of an above-ground swimming pool, such as a spa or an above-ground pool, this heating device as comprising:

- a frame which has:
  - a base which is intended to rest on the ground when the heating device is in use,
  - a rear face, which rises from the base and which is adapted to rest against the pool when in use;
  - a front face, which rises from the base, being opposite to the rear face, and
  - an upper face, which connects the rear and front faces and which generally has a stepped shape, having at least two levels, which, in use, are at different respective heights and the highest level of which opens onto the rear face while the other level or levels are distributed substantially uniformly between the base and the highest level, so that, in use, a user can access the pool by walking successively on the levels of the stepped shape by ascending these levels from the ground to enter the pool and descending these levels to the ground to exit the pool,
- an air-water heat pump, which is adapted to transfer heat from the air to the water of the pool, the heat pump being arranged in an internal volume of the frame, which is defined between the base and the rear, front and upper faces, and through which air from outside the frame circulates, and
- connection members for connecting to the pool, adapted both to supply water of the pool from outside the frame to the heat pump and to return the water heated by the heat pump to the outside of the frame to supply the pool.

Thus, the idea behind the invention is to seek to use an air-water heat pump to heat the water of the above-ground pool efficiently by placing this heat pump in a stepped frame, allowing the user to access the pool by climbing on it as if on a stepladder or stair steps. To this end, the frame has a stepped upper face with several levels, typically two or three levels, which follow each other at regularly increasing heights between a front surface of the frame, facing away from the pool, and a rear surface of the frame, juxtaposed against the outer wall of the pool. Moreover, the frame defines an internal volume under its stepped upper face, inside which the heat pump is arranged and through which air from outside the frame circulates: the heat pump is thus aesthetically concealed, while being operational in the immediate vicinity of the pool, which limits pressure losses and facilitates the connection between the heat pump and the pool by ad hoc members to be connected to the heating device according to the invention. Advantageously, of course, the heating device according to the invention is removable with respect to the pool, the members to be connected then provided reversible.

In practice, the step-shaped upper face of the frame can have very varied geometric and dimensional specifics, as long as this upper face allows the user to walk successively on the levels of the stepped shape, in the manner of climbing up and down a staircase, in order to easily access the water of the pool, to enter inside the enclosure thereof from the ground outside the pool, and then to leave the enclosure and return to the ground outside the pool. Thus, the stepped shape may resemble stair treads, a stepladder, the rungs of an inclined ladder, etc.

Similarly, the heating device according to the invention can be used with all types of above-ground pools, such as those discussed above. The invention has a particular application to spas, for which the use of a staircase with a few steps is very common: the invention makes it possible to easily associate an air-water heat pump with an existing spa, without substantially modifying the latter or further encumbering its periphery, since it is sufficient to replace the traditional staircase by the heating device according to the invention and to connect this heating device to the spa, to the hydraulic circuit of the spa in particular.

According to additional advantageous features of the heating device according to the invention:

- two or three levels are provided for the stepped shape of the upper side of the frame.
- the heat pump is arranged substantially vertically in line with a portion of the upper side of the frame, located at the highest level of the stepped shape.
- the connection members are arranged through the rear side of the frame.
- the frame includes perforated walls for letting air pass between the outside of the frame and the internal volume of the frame; the perforated walls include at least a first perforated wall arranged on the front face of the frame and/or on part(s) of the upper face of the frame, which are located between two consecutive levels of the stepped shape; and the perforated walls also include at least a second perforated wall arranged on one and/or the other of side faces of the frame.
- the heat pump includes a fan adapted to drive into the internal volume of the frame some air whose heat is transferred to the water of the pool by the heat pump, the fan being configured both to bring air from the outside of the frame into the internal volume of the frame via the first perforated wall or walls, and to discharge air from the internal volume of the frame to the outside of the frame via the second perforated wall or walls.
- the frame includes stair steps which constitute the levels of the stepped shape of the upper face of the frame.
- the frame also includes risers, which are respectively associated with the stair steps and which integrate the first perforated wall or walls.

It is also an object of the invention to provide a bathing facility, comprising:

- an above-ground pool comprising an enclosure, intended to contain water for bathing therein, and a hydraulic circuit adapted to suck in the water contained in the enclosure, to treat the water thus sucked in, and to return the water thus treated to the enclosure, and
- a heating device as defined above, the rear face of the frame of which is adjoined to the outer face of a side wall of the enclosure, and the heat pump of which is connected to the hydraulic circuit in such a way that water circulating in this hydraulic circuit is sent to the heat pump in order to be heated therein before being returned to the hydraulic circuit. Advantageously, the above-ground pool of this facility is a spa.

BRIEF DESCRIPTION OF THE DRAWINGS

The invention will be better understood from the following description, given only by way of example and made with reference to the drawings in which:

FIGS. 1 and 2 show a bathing facility comprising a surface spa 1 and a device 2 for heating the water of the spa 1.

DETAILED DESCRIPTION OF EMBODIMENTS

The spa 1 comprises an enclosure 3 that contains water for bathing in, when the spa 1 is in use. Depending on the size of the enclosure 3, one or more adults can thus immerse their bodies in the water contained by the enclosure 3.

The design of the enclosure 3 is not limitative. The enclosure 3 can be self-supporting, by being at least partially inflatable for example, or it can incorporate a supporting structure that holds a tank or an enclosure containing the water of the spa. In all cases, the enclosure 3 is above-ground, that is, when the spa 1 is in use, the enclosure 3 rises upward from the ground by resting directly on the latter, without being underground or else marginally underground at the base of the enclosure 3. Thus, the side wall of the enclosure 3 protrudes from the ground, over a height of several tens of centimeters.

Figure 2:
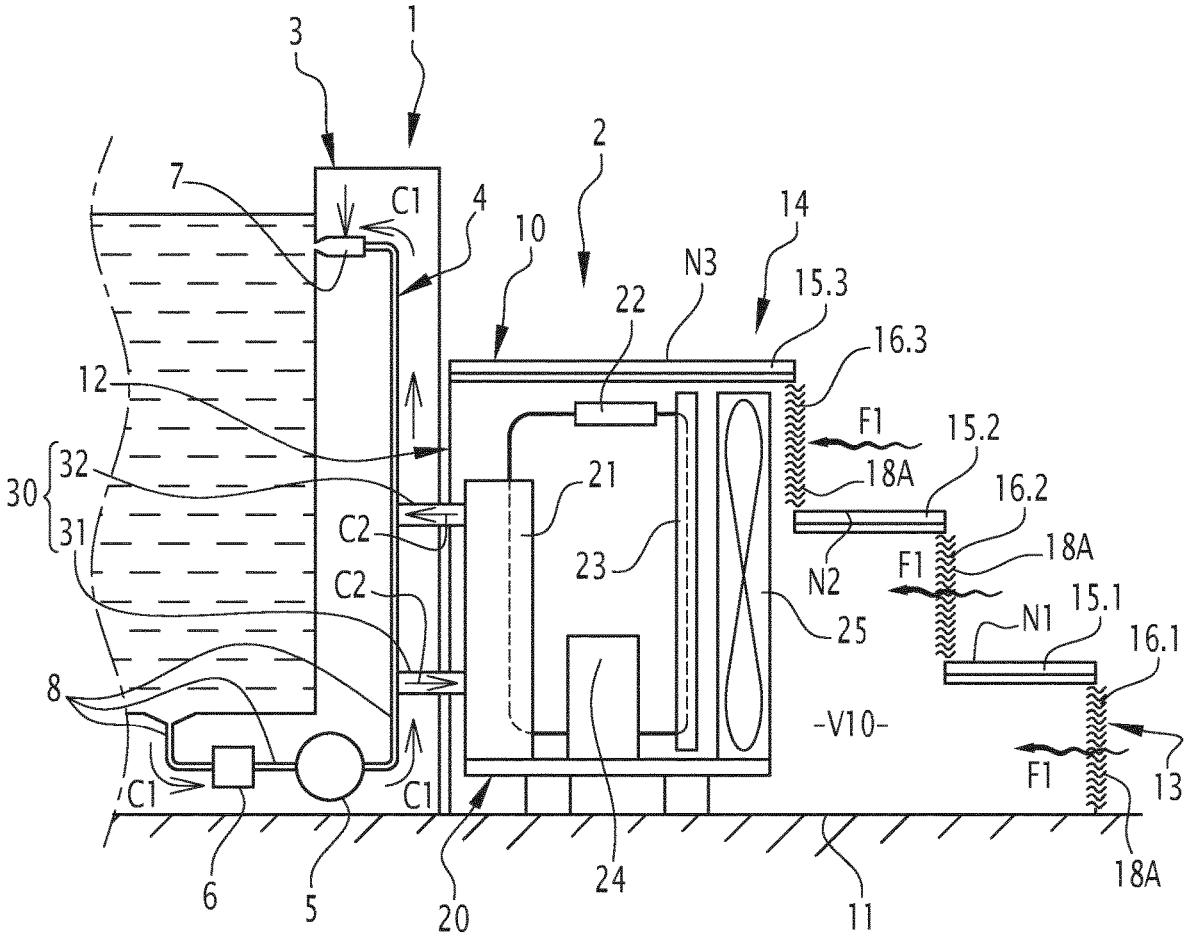
FIG. 2 is a schematic section according to plane II of FIG. 1.

The spa 1 also includes a hydraulic circuit 4 schematically represented in FIG. 2. In this FIG. 2, the hydraulic circuit 4 is integrated into the thickness of the wall of the enclosure 3, but this schematic arrangement is not limitative and other arrangements, known in the field, can be envisaged. In any case, the hydraulic circuit 4 is designed to form a loop for the circulation of the water contained in the enclosure 3, this loop being closed on the inside of this enclosure: the hydraulic circuit 4 thus allows the water contained in the enclosure 3 to be sucked in, the water thus sucked in to be treated, and then to return the water thus treated into the enclosure 3, as indicated by the water circulation arrows C1. To this end, in the example of embodiment considered here, the hydraulic circuit 4 comprises:

- a pump 5, in particular with electric motorization, which is designed to drive the water in the hydraulic circuit 4 from the upstream end thereof to the downstream end of the hydraulic circuit, these two ends opening out inside the enclosure 3, a filter 6, which retains impurities of the water passing through it, delivery nozzles 7, which are arranged at the downstream end of the hydraulic circuit 4 and which reintroduce the water flowing in the hydraulic circuit 4 into the enclosure 3, in the form of bubble jets, for example, by mixing, through the delivery nozzles, the water flowing in the hydraulic circuit 4 with air injected from outside the enclosure 3, and pipes 8 connecting the upstream end of the hydraulic circuit 4, the filter 6, the pump 5 and the delivery nozzles 7 to each other.

The specifics of the hydraulic circuit 4 are not limitative as long as this hydraulic circuit ensures the circulation of water in a closed loop in the enclosure 3, between the upstream and downstream ends of the hydraulic circuit. In particular, in addition to and/or replacing the filtration operated by the filter 6, one or more other treatments of the water circulating in the hydraulic circuit 4 can be implemented by ad hoc equipment integrated into the hydraulic circuit. Similarly, the delivery nozzles 7 envisaged above can be replaced by other delivery elements according to the effects desired for the reintroduction of the water flow in the enclosure 3, as is well known in the field of spas.

Figure 1:
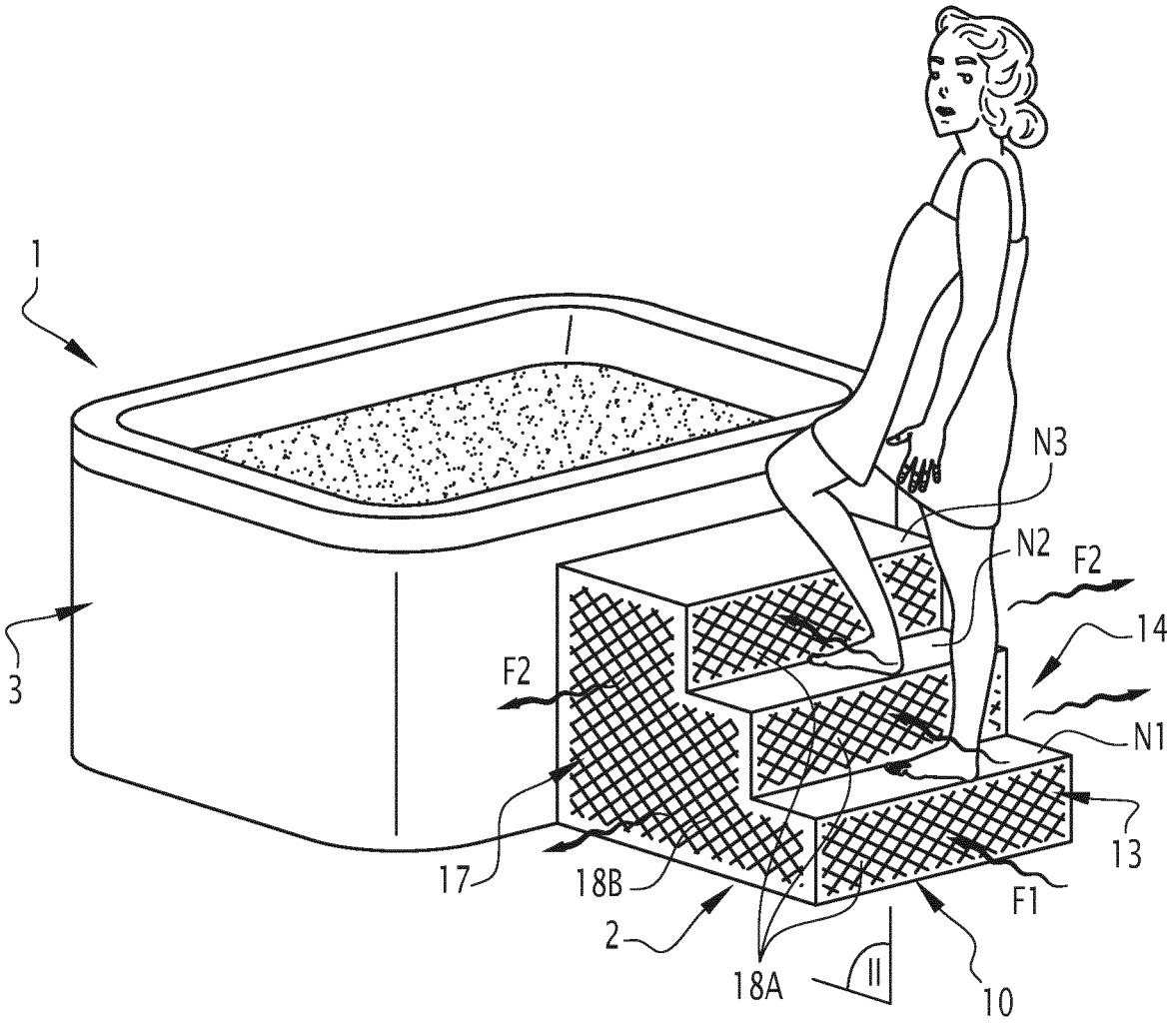
FIG. 1 is a schematic perspective view of a bathing facility comprising a heating device according to the invention.

The heating device 2 includes a frame 10 which, as is clearly visible in FIGS. 1 and 2, gives the heating device 2 an external appearance similar to that of a staircase with a few steps, in this case three steps, for the example considered here.

More specifically, the frame 10 includes a base 11 which, as is clearly visible in FIG. 2, rests directly on the ground outside the spa 1 when the heater and the bathing facility more generally are in use. The frame 10 has a rear face 12 and a front face 13, each of which rises from the base 11 and is opposite each other, being located at opposite ends of the base 11. In use, the rear face 12 of the frame 10 is designed to abut the outer face of the side wall of the enclosure 3, by being flush against that side wall or slightly spaced from that side wall.

Overhanging its base 11, the frame 10 has an upper face 14, which connects the rear 12 and front 13 faces to each other and which has is step-shaped overall, typically here as a staircase. This stepped shape has several levels which, when the heating device 2 is in use, are located at different respective heights with respect to the ground and which are distributed in a substantially regular manner along the vertical, that is, along a direction perpendicular to the ground: in the example embodiment considered here, the stepped shape of the upper face 14 thus has three levels, namely a lowest level, N1, an intermediate level, N2 and a highest level, N3. The highest level N3 opens onto the rear face 12 of the frame 10 and the other levels N1 and N2 are distributed in a substantially regular manner between the highest level N3 and the base 11, with the lowest level N1 opening onto the front face 13. In practice, the vertical spacing between levels N1, N2 and N3 is intended to be constant, to within a few clearances, or, more generally, substantially constant, for example to within 10%: in any case, this spacing must allow a user to be able to walk successively on the levels N1, N2 and N3 as if going up and down a staircase.

Of course, the frame 10 is designed to support the weight of a user standing on any of the levels N1, N2 and N3. According to a convenient embodiment, implemented in the example embodiment considered in the Figures, the frame 10 has stair steps 15.1, 15.2 and 15.3 that constitute the levels N1, N2 and N3 respectively and which are supported by structural parts of the frame 10, not detailed in the Figures. The material(s) constituting the stair steps 15.1, 15.2 and 15.3, as well as constituting the aforementioned structural parts are not limitative, as long as sufficient mechanical resistance is guaranteed for a user to be able to go up and down on these steps. Similarly, the depth of the stair steps 15.1, 15.2 and 15.3, that is their dimension in a horizontal direction connecting the rear faces 12 and the front faces 13, is not limitative, as long as the user can place a sufficient part of his foot on each of these steps when he walks successively on the levels N1, N2 and N3, as illustrated in FIG. 1. This being the case, according to an advantageous arrangement which is implemented in the example of embodiment considered in the Figures, the depth of stair step 15.3 may be deeper than the other stair steps 15.1 and 15.2: more generally, the part of the upper surface 14 of the frame 10 located at the highest level N3 advantageously has a greater depth than the parts of this upper surface 14 located at the other levels, which is safer for the user, giving him/her a greater surface area on which to place his/her feet when standing on the highest level N3.

In any case, the frame 10 defines an internal volume V10 which, as clearly visible in FIG. 2, is defined between the base 11 and the rear 12, front 13 and upper 14 faces, and which, as clearly visible in FIG. 12, is also defined by two lateral faces 17 of the frame 10, each of which extends from the base 11 to the upper 14 face and which are opposite each other. This internal volume V10 thus corresponds to a cavity defined inside the frame 10, inside which air from outside the frame 10 can circulate.

To control the conditions of air circulation through the frame 10, the latter advantageously comprises perforated walls 18A and 18B which allow air to pass between the outside of the frame 10 and the internal volume V10. As clearly visible on FIGS. 1 and 2, the perforated walls 18A are arranged on the front face 13 of the frame and on the parts of the upper face 14 of the frame, located between the consecutive levels N1 and N2 and between the consecutive levels N2 and N3. In the example embodiment considered here, these perforated walls 18A are integrated to risers 16.1, 16.2 and 16.3, which are respectively associated to the stair steps 15.1, 15.2 and 15.3. The perforated walls 18B are arranged on the lateral faces 17 of the frame 10, as shown in FIG. 1. The relevance of the respective arrangements of the perforated walls 18A and the perforated walls 18B will appear a little further on. In any case, the constitution of the perforated walls 18A and 18B is not limitative and may be chosen from among grids, bars, grid walls, perforated plates, etc.

The heating device 2 also includes a heat pump 20. This heat pump 20 is an air-water heat pump, allowing the heat from the air, passing through the heat pump, to be transferred to the water also passing through this heat pump. Within the heating device 2, when in use, the heat pump 20 is adapted to transfer the heat from the ambient air to the water in the spa 1.

As is clearly visible in FIG. 2, the heat pump 20 is arranged within the frame 10, that is, within the internal volume V10 of this frame. According to an advantageous convenient arrangement, implemented in the example considered in FIG. 2, the heat pump 20 is arranged, entirely or at least essentially, only in a part of the internal volume V10, namely vertically above the stair step 15.1, that is, more generally, vertically in line with a part of the upper surface 14 of the frame 10, which is located at the highest level N3 of the stepped shape: this arrangement of the heat pump 20 in the internal volume V10 makes it possible to position the heat pump 20 in the immediate vicinity of the rear face 12 of the frame 10 and thus as close as possible to the spa 1 when the heating device 2 is in use within the bathing facility, while taking advantage of the fact that the distance between the base 11 and the highest level N3 is at its maximum compared to the other levels N1 and N2, as well as, if necessary, taking advantage of the fact that the depth of the part of the upper side 14 located at the highest level N3 can made greater than that of the parts of this upper side 14 located at the other levels N1 and N2.

The embodiment of the heat pump 20 is not limitative, as long as this heat pump 20 transfers the heat of the air coming from the outside of the frame and circulating through the internal volume V10 to the water of the spa 1. To this end, in a manner known per se, the heat pump 20 includes components allowing for a thermodynamic transfer of heat from the air, circulating through the internal volume V10, to the water that comes from the spa 1 and that is returned to the spa 1, once heated by the heat pump 20. As schematically shown in FIG. 2, the aforementioned components of the heat pump 20 may thus include:

- a condenser 21, in which a refrigerant from the heat pump 20 releases its heat to the water in the spa 1, circulating through said condenser,
- an expansion valve 22, which reduces the pressure of the refrigerant that has changed from a gas to a liquid in the condenser 21,
- an evaporator 23, which takes heat from the air circulating in the internal volume V10 to vaporize the refrigerant circulating in this evaporator, and
- a compressor 24, which raises the pressure and the temperature of the gaseous refrigerant by compressing it, by members of its actuation by a motorization, typically electric.

In addition, the heat pump 20 advantageously includes a fan 25 which, when actuated by motorization, typically electric, turns on itself and thus drives the air in the internal volume V10, forcing the circulation of this air through the evaporator 23. This fan 25 is configured, by its arrangement and structure in particular, to direct the air circulation through the frame 10, on the one hand by causing air to enter from outside the frame 10 to inside the internal volume V10 via the perforated walls 18A, as indicated by the arrows F1 in FIGS. 1 and 2, and, on the other hand, by expelling air from the internal volume V10 to the outside of the frame 10 via the perforated walls 18B, as indicated by the arrows F2 on FIG. 1. In this way, the cooled air that has flowed through the heat pump 20 is discharged from the heating device 10 through the side faces 17 of the frame 10, without being sent directly onto the user standing on the levels N1, N2 and N3 of the stepped shape of the upper face 14 of the frame.

The heating device 2 further includes connecting pipes 31 and 32, shown schematically in FIG. 2, which allow the heating device 2 to be connected to the spa 1. The connecting pipe 31 is adapted to bring water of the spa 1 from outside the frame 10 to the heat pump 20, being connected to the hydraulic circuit 4, typically to one of the pipes 8 of this hydraulic circuit. The connecting pipe 32 is adapted to return the water heated by the heat pump 20 to the outside of the frame 10 to supply the spa 1, being connected to the hydraulic circuit 4, typically to one of the pipes 8. Of course, the connection pipes 31 and 32 are only a non-limitative example for connection members 30 of the heating device 2 allowing the latter to connect to the spa 1, advantageously in a removable way, to allow the heating device 2 to be installed and removed at will with respect to the spa 1. In any case, the connection of these connection members 30 to the spa 1 is advantageously made on the hydraulic circuit 4 of the latter so that, under the effect of the water drive in this hydraulic circuit 4, typically by the pump 5, the water circulates in the connection members 30 and in the heat pump 20, as indicated by the arrows C2 on FIG. 2. Of course, the connection members 30 include fittings and valves allowing their connection to the hydraulic circuit 4.

It is understood that, due to their function, the connection members 30 necessarily extend between the inside and the outside of the frame 10, passing through the base 11 and/or one of the rear 12, front 13, upper 14 and side 17 faces. In particular, the corresponding arrangement of the connection members 30 may be dependent on the structure of the heat pump 20 and/or the configuration of the hydraulic circuit 4. That said, according to a particularly advantageous embodiment, implemented in the example embodiment considered here, the connection members 30 are arranged through the rear side 12 of the frame 10: as is clearly visible in FIG. 2, the connection pipes 31 and 32 thus pass through the rear side 12 of the frame 10. In this way, the hydraulic connection between the heating device 2 and the spa 1 is particularly discreet, while being efficient, in particular by limiting the pressure losses and heat losses for the water circulating between the heat pump 20 and the hydraulic circuit 4.

When the heating device 2 is in use and connected to the spa 1, as in FIGS. 1 and 2, the heat pump 20 is concealed inside the frame 10. The user can access the spa 1 by walking successively on the levels N1, N2 and N3 of the stepped shape of the upper side 14 of the frame 10: thus, when the user wants to enter the interior of the enclosure 3 of the spa 1, (s)he goes up the upper face 14 of the frame 10, as if climbing a staircase; when the user wants to exit the enclosure 3, he goes up, from the interior of the enclosure 3, on the highest level N3 of the upper face 14 of the frame 10, and then descends to the ground by walking successively on level N2 and level N1, as if descending stairs. In addition, the spa water is heated by the heat pump 20. In practice, the control of the heat pump 20 by the user, in particular the adjustment of its setpoint temperature, can either be done directly at the control system level of the heating device 2, typically electronic, via a dedicated interface which is carried by the frame 10 or transmitted remotely, or be provided through an interface of the spa 1 by members of the interconnection between the control system of the spa 1 and the control system of the heating device 2.

Various arrangements and variants of the bathing facility 1 described so far, in particular its heating device 2, are also conceivable. By way of example:

- the number of levels of the step-shaped upper face 14 of the frame 10 is not limited to three, as in the example considered in the Figures; in particular, two levels are sufficient, but more than three levels is conceivable; in practice, the number of levels is related to the height of the side wall of the enclosure 3 relative to the ground, so that, for most bathing facilities, this number of levels is preferably two or three;
- although arranged in the internal volume V10 of the frame 10, the heat pump 20 can advantageously be raised with respect to the ground, typically by a few tens of millimeters, thus making it possible to control the flow of condensates produced by the heat pump 20, in particular by sending these condensates into a drainage circuit equipping the spa 1;

for facility and maintenance, one or more accesses to the internal volume V10 of the frame 10 can be provided by making certain external parts of the frame 10 removable, in particular at the level of one and/or the other of the lateral faces 17;

the electrical supply of the heat pump 20 can be provided either through the spa 1 or autonomously;

rather than the heating device 2 being connected to the hydraulic circuit 4 of the spa 1 and benefiting from water driving through its heat pump 20 by the pump 5 of this hydraulic circuit, the heating device 2 can be connected to the spa 1 in such a way that its connection members 30 open directly into the enclosure 3 of the spa 1, that is, without water, sent from the enclosure 3 of the spa 1 to the heat pump 20 and then sent back from the latter to the interior of the enclosure 3, transiting through the hydraulic circuit 4; in this case, a pump to drive the water between the enclosure 3 and the heat pump 20 is then necessary, advantageously being integrated into the heating device 2, in particular housed inside the frame 10, in particular in the internal volume V10 of the latter; and/or as mentioned at the beginning of this document, the spa 1 described with respect to the Figures is only an example of an above-ground swimming pool with which the heating device 2 can be used.

The invention claimed is:

1. A heating device for heating the water of an above-ground pool, such as a spa or an above-ground swimming pool, comprising:

a frame comprising:

a base which rests on the ground when the heating device is in use;

a rear face, which rises from said base and which rests against the pool when in use;

a front face, which rises from said base, being opposite to said rear face; and an upper face, which connects said rear and said front faces and which comprises a stepped shape, comprising at least two levels, which, in use, are at different respective heights, a highest level of which opens onto said rear face while other level or levels of which are distributed substantially uniformly between said base and the highest level, so that, in use, a user accesses the pool by walking successively on said levels of said stepped shape by ascending said levels from the ground to enter the pool and descending said levels to the ground to exit the pool;

an air-water heat pump, which is adapted to transfer heat from the air to the water of the pool, the heat pump being arranged in an internal volume of said frame, which is defined between said base said rear, said front and said upper faces, and through which air from outside said frame circulates; and connection members for connecting to the pool, supplying water of the pool from outside said frame to said heat pump and returning water heated by said heat pump to outside of said frame to supply the pool.

2. The heating device according to claim 1, wherein two or three levels are provided for said stepped shape of said upper side of said frame.

3. The heating device according to claim 1, wherein said heat pump is arranged substantially vertically in line with a portion of said upper side of said frame, located at the highest level of said stepped shape.

4. The heating device according to claim 1, wherein said connection members are arranged through said rear side of said frame.

5. The heating device according to claim 1, wherein said frame comprises stair steps which comprise the levels of said stepped shape of said upper face of said frame.

6. The heating device according to claim 1, wherein said frame comprises perforated walls for letting air pass between outside of said frame and the internal volume of said frame, the perforated walls comprising:

at least a first perforated wall arranged on said front face of said frame and/or on part(s) of said upper face of said frame, which are located between two consecutive levels of said stepped shape; and at least a second perforated wall arranged on one and/or the other of side faces of said frame.

7. The heating device according to claim 6, wherein said heat pump comprises a fan adapted to drive into the internal volume of said frame some air whose heat is transferred to the water of the pool by said heat pump, the fan being configured both to bring air from outside of said frame into the internal volume of said frame via said first perforated wall or walls, and to discharge air from the internal volume of said frame to outside of said frame via said second perforated wall or walls.

8. The heating device according to claim 6, wherein said frame comprises stair steps which comprise the levels of said stepped shape of said upper face of said frame, and wherein said frame further comprises risers, which are respectively associated with said stair steps and which integrate said first perforated wall or walls.

9. A bathing facility, comprising:

an above-ground pool comprising:

an enclosure, intended to contain water for bathing therein; and a hydraulic circuit adapted to suck in the water contained in said enclosure, to treat the water thus sucked in, and to return the water thus treated to said enclosure, and a heating device according to claim 1, the rear face of the frame of which is adjoined to the outer face of a side wall of said enclosure, and the heat pump of which is connected to said hydraulic circuit in such a way that water circulating in said hydraulic circuit is sent to the heat pump of the heating device in order to be heated therein before being returned to said hydraulic circuit.

10. The bathing facility according to claim 9, wherein the pool is a spa.

* * * * *